US008196657B2

(12) United States Patent
Kennedy

(10) Patent No.: US 8,196,657 B2
(45) Date of Patent: Jun. 12, 2012

(54) ELECTRICAL SUBMERSIBLE PUMP ASSEMBLY

(75) Inventor: Steven Charles Kennedy, Houston, TX (US)

(73) Assignee: Oilfield Equipment Development Center Limited, Mahe, Victoria (SC)

( * ) Notice: Subject to any disclaimer, the term of this patent is extended or adjusted under 35 U.S.C. 154(b) by 253 days.

(21) Appl. No.: 12/112,854

(22) Filed: Apr. 30, 2008

(65) Prior Publication Data

US 2009/0272538 A1 Nov. 5, 2009

(51) Int. Cl.
*E21B 43/38* (2006.01)

(52) U.S. Cl. ..... 166/265; 166/105.5

(58) Field of Classification Search ..... 166/265, 166/105.5
See application file for complete search history.

(56) References Cited

U.S. PATENT DOCUMENTS

| | | | | |
|---|---|---|---|---|
| 2,190,104 | A * | 2/1940 | McCoy | 166/105.5 |
| 4,832,127 | A | 5/1989 | Thomas et al. | |
| 5,154,588 | A * | 10/1992 | Freet et al. | 417/423.3 |
| 5,271,725 | A * | 12/1993 | Freet et al. | 417/423.3 |
| 5,462,116 | A * | 10/1995 | Carroll | 166/249 |
| 5,845,709 | A | 12/1998 | Mack et al. | |
| 5,979,559 | A | 11/1999 | Kennedy | |
| 6,033,567 | A * | 3/2000 | Lee et al. | 166/265 |
| 6,056,511 | A * | 5/2000 | Kennedy et al. | 417/53 |
| 6,167,965 | B1 * | 1/2001 | Bearden et al. | 166/250.15 |
| 6,361,272 | B1 | 3/2002 | Bassett | |
| 6,364,013 | B1 * | 4/2002 | Watson et al. | 166/105 |
| 6,412,563 | B1 * | 7/2002 | William St. Clair et al. | 166/372 |
| 6,533,033 | B2 | 3/2003 | Skillman | |
| 6,684,956 | B1 | 2/2004 | Berry | |
| 6,702,027 | B2 | 3/2004 | Olson et al. | |
| 6,715,556 | B2 | 4/2004 | Mack et al. | |
| 6,723,158 | B2 | 4/2004 | Brown et al. | |
| 6,932,160 | B2 | 8/2005 | Murray et al. | |
| 6,937,923 | B1 | 8/2005 | Bassett | |
| 7,069,985 | B2 * | 7/2006 | Wang | 166/68 |
| 7,241,104 | B2 | 7/2007 | Wilson et al. | |
| 7,377,313 | B2 | 5/2008 | Brown et al. | |
| 7,445,429 | B2 | 11/2008 | Wilson et al. | |
| 7,543,633 | B2 | 6/2009 | Brown et al. | |
| 7,766,081 | B2 | 8/2010 | Brown et al. | |
| 7,798,211 | B2 | 9/2010 | Brown et al. | |
| 7,798,215 | B2 | 9/2010 | Leuthen et al. | |
| 7,806,186 | B2 | 10/2010 | Brown et al. | |
| 7,882,896 | B2 | 2/2011 | Wilson et al. | |
| 7,984,766 | B2 | 7/2011 | Brown et al. | |
| 7,997,335 | B2 | 8/2011 | Brown et al. | |
| 8,079,418 | B2 | 12/2011 | Brown et al. | |
| 2004/0050552 | A1 * | 3/2004 | Zupanick | 166/313 |
| 2004/0074390 | A1 * | 4/2004 | Ford et al. | 95/260 |

* cited by examiner

*Primary Examiner* — Daniel P Stephenson
*Assistant Examiner* — Blake Michener
(74) *Attorney, Agent, or Firm* — Patterson & Sheridan, L.L.P.

(57) ABSTRACT

In one embodiment, a pump assembly for pumping a wellbore fluid in a wellbore includes a pump, a fluid separator, a motor for driving the pump, and a shroud disposed around the fluid separator for guiding a gas stream leaving the fluid separator, wherein the gas stream is prevented from mixing with fluids in the wellbore.

17 Claims, 7 Drawing Sheets

ELECTRICAL SUBMERSIBLE PUMP ASSEMBLY

BACKGROUND OF THE INVENTION

1. Field of the Invention

Embodiments of the present invention generally relate to an electrical submersible pump assembly adapted to efficiently reduce a gas content of a pumped fluid. Particularly, embodiments of the present invention relate to an electrical submersible pump assembly having a device to direct gas flow leaving the assembly.

2. Description of the Related Art

Many hydrocarbon wells are unable to produce at commercially viable levels without assistance in lifting formation fluids to the earth's surface. In some instances, high fluid viscosity inhibits fluid flow to the surface. More commonly, formation pressure is inadequate to drive fluids upward in the wellbore. In the case of deeper wells, extraordinary hydrostatic head acts downwardly against the formation, thereby inhibiting the unassisted flow of production fluid to the surface.

In most cases, an underground pump is used to urge fluids to the surface. Typically, the pump is installed in the lower portion of the wellbore. Electrical submersible pumps are often installed in the wellbore to drive wellbore fluids to the surface.

In a well that has a high volume of gas, a gas separator may be included in the ESP system to separate the gas from the liquid. The gas is separated in a mechanical or static separator and is vented to the well bore where it is vented from the well annulus. The separated liquid enters the centrifugal pump where it is pumped to the surface via the production tubing.

In a well that produces methane gas, the electrical submersible pump is generally used to pump the water out of the wellbore to maintain the flow of methane gas. Typically, the water is pumped up a delivery pipe, while the methane gas flows up the annulus between the delivery pipe and the wellbore. However, it is inevitable that some of the methane gas entrained in the water will be pumped by the pump. Wells that are particularly "gassy" may experience a significant amount of the methane gas being pumped up the delivery pipe.

For coal bed methane wells, it is generally desirable that no methane remain in the water. Methane that remains in the water must be separated at the surface which is a costly process. Therefore, a gas separator may be used to separate the gas from liquid to reduce the amount of methane gas in the pumped water.

FIG. 1 shows a prior art downhole electric submersible pump (ESP) assembly 10 positioned in a wellbore 5. The ESP assembly 10 includes a motor 20, a motor seal 25, a gas separator 30, and a pump 40. The gas separator 30 is positioned between the pump 40 and the motor seal 25. The motor 20 is adapted to drive the gas separator 30 and the pump 40. A central shaft extends from the motor 20 and through the motor seal 25 for engaging a central shaft of the separator 30 and a central shaft of the pump 40. Fluid enters the ESP assembly 10 through the intake port 32 in the lower end of the gas separator 30. The fluid is separated by an internal rotating member with blades attached to the shaft of the gas separator 30. The gas separator 30 may also have an inducer pump or auger at its lower end to aid in lifting the fluid to the blades. Centrifugal force created by the rotating separator member causes denser fluid (i.e. fluid having more liquid content) to move toward the outer wall of the gas separator 30. The fluid mixture then travels to the upper end of gas separator 30 toward a flow divider in the gas separator. The flow divider is adapted to allow the denser fluid to flow toward the pump, while diverting the less dense fluid to the exit ports 38 of the gas separator 30. Gas leaving the gas separator 30 travels up the annulus 7.

One problem that arises is that the gas leaving the gas separator may commingle with the fluid flowing toward the intake port. In this respect, the gas content of the pumped fluid may be inadvertently increased by the gas leaving the separator. The increase in gas entering the gas separator when this occurs reduces the efficiency of the gas separator which may result in incomplete separation of the gas from the liquid. This has negative effects on pump performance and in a coal bed methane well will result in methane in the water being pumped from the well.

There is a need, therefore, for an apparatus and method for efficiently reducing a gas content of a pumped fluid. There is also a need for apparatus and method for maintaining a separated gas from a fluid to be pumped.

SUMMARY OF THE INVENTION

Embodiments of the present invention provide methods and apparatus for preventing a separated gas leaving a pump assembly from mixing with a fluid in the wellbore.

In one embodiment, a pump assembly for pumping a wellbore fluid in a wellbore comprises a pump; a gas separator; a motor for driving the pump; and a shroud disposed around the gas separator for guiding a gas stream leaving the gas separator, wherein the gas stream is prevented from mixing with fluids in the wellbore. In one embodiment, the shroud guides the gas stream to a location above a liquid level in the well bore.

In another embodiment, a method of pumping wellbore fluid in a wellbore includes receiving the wellbore fluid in a separator; separating a gas stream from the wellbore fluid; exhausting the gas stream from the separator; and guiding a flow of the exhausted gas stream up the wellbore while substantially preventing the gas stream from mixing with fluids in the wellbore. The method further includes venting the gas stream above a fluid level in the wellbore and pumping the wellbore fluid remaining in the separator. In one embodiment, the method also includes disposing a shroud around the separator to guide the flow of the exhausted gas stream.

In another embodiment gas is vented above a zone where all the fluid is entering the well annulus. This can be a perforated zone or entry of multilateral legs in the well.

In yet another embodiment, a pump assembly for pumping a wellbore fluid in a wellbore includes a pump, a gas separator having a vent port, a motor for driving the pump, and a tubular sleeve in fluid communication with the vent port, wherein a gas stream in the tubular sleeve is prevented from mixing with fluids in the wellbore.

In yet another embodiment, a pump assembly for pumping a wellbore fluid in a wellbore includes a pump, a gas separator having a vent port, a motor for driving the pump, and a flow control device coupled to the vent port, wherein the vent port controls the outflow of a separated gas stream and the inflow of fluids through the vent port. In one embodiment, the flow control device includes an elastomeric tubular sleeve disposed around the vent port. In another embodiment, one end of the tubular sleeve is attached to the gas separator and another end of the tubular sleeve has a clearance between the tubular sleeve and the gas separator.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Embodiments of the present invention provide methods and apparatus for preventing a separated gas from commingling with fluids in the well bore.

Figure 1:
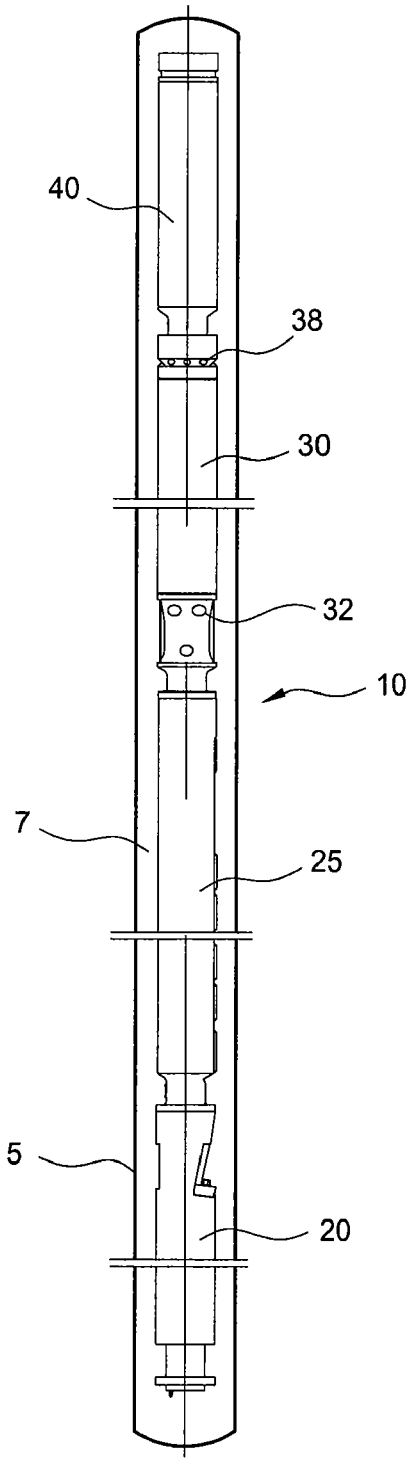
FIG. 1 (PRIOR ART)
FIG. 1 is a schematic view of prior art electric submersible pump.
Figures 2, 2A:
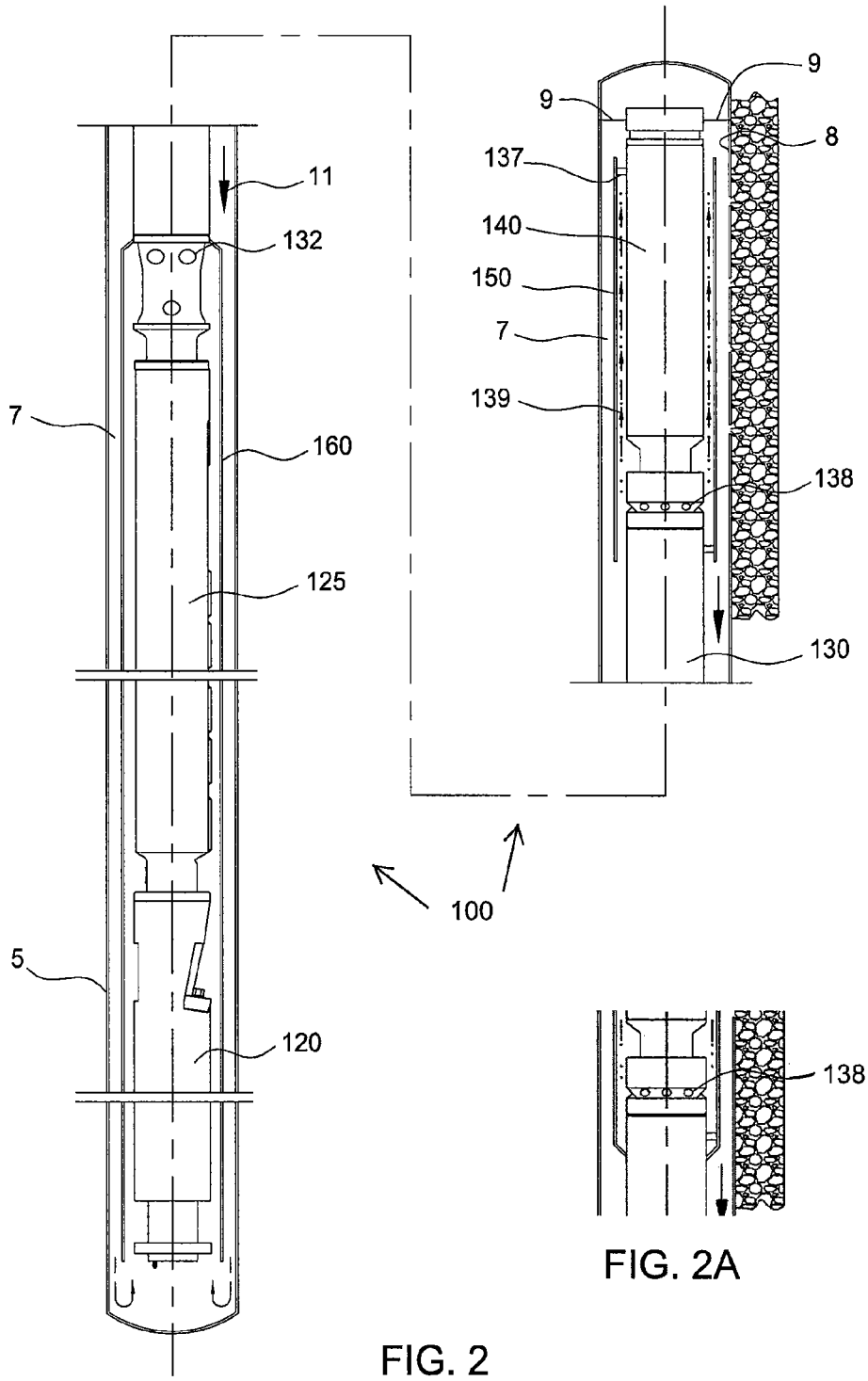
FIG. 2 is a schematic view of an embodiment of an electric submersible pump assembly.
FIG. 2A illustrates an alternative embodiment.

FIG. 2 shows an embodiment of an electric submersible pump assembly 100 adapted to prevent the separated gas from commingling with the wellbore fluid. The ESP assembly 100 includes a motor 120, a motor seal 125, a gas separator 130, and a pump 140. The motor 120 is adapted to drive the gas separator 130 and the pump 140. A central shaft extends from the motor 120 and through the motor seal 125 for engaging a central shaft 133 of the separator 130 and a central shaft of the pump 140. The motor seal 125 may be used to couple the motor 120 to the separator 130 and the pump 140. In one embodiment, the motor seal 125 is a barrier type seal having an elastomeric diaphragm or bag. Other suitable motors and motor seals known to a person of ordinary skill are also contemplated.

Figure 3:
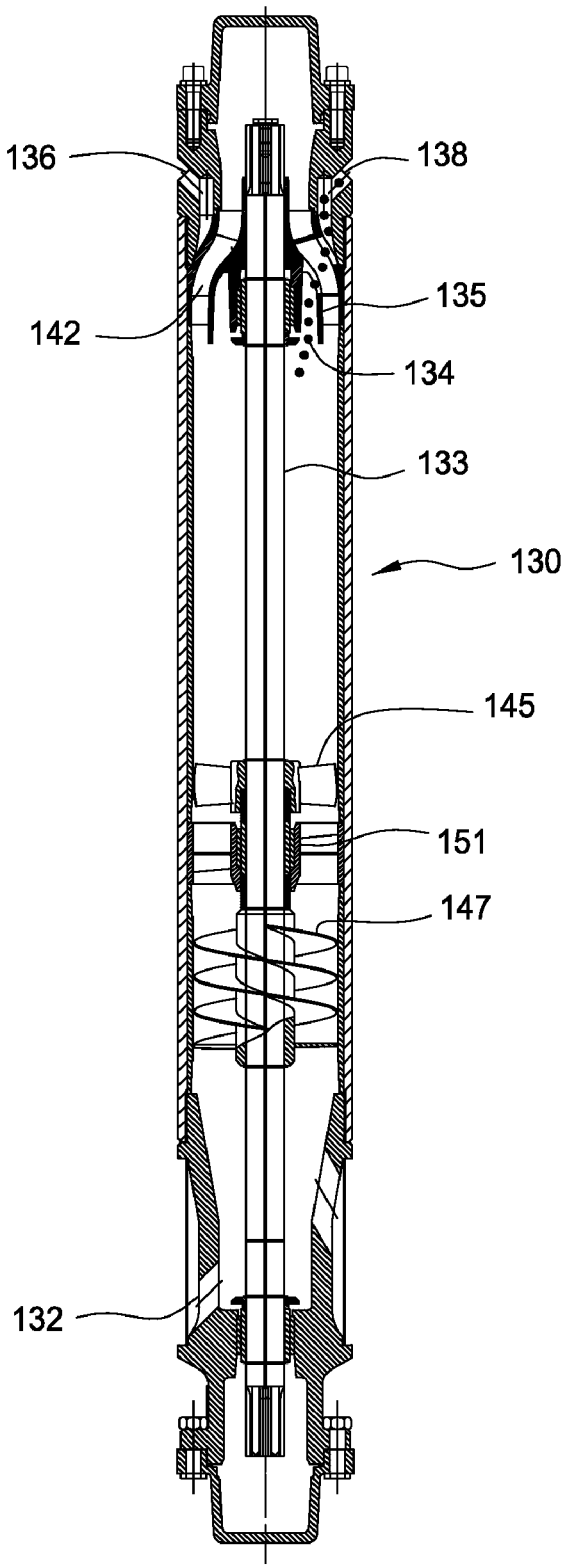
FIG. 3 is a cross-sectional view of a gas separator highlighting the separation of liquid and gas shown in FIG. 2.

FIG. 3 illustrates an exemplary gas separator suitable for use with the electric submersible pump assembly 100. In one embodiment, the gas separator 130 includes one or more intake ports 132 at its lower end and one or more exhaust ports 138 at its upper end. The separator 130 includes a rotating member 145 with blades (e.g., an impeller) that is attached to the shaft 133 of the separator 130 and is rotatable therewith. The separator 130 may optionally include an inducer pump or auger 147 at its lower end to aid in lifting the fluid to the blades. The separator 130 may further include a bearing support 151 to provide support to the shaft 133 during rotation. Rotation of the shaft 133 by the motor 120 causes the inducer 147 to rotate, thereby lifting the fluids entering the intake ports 132. Rotation of the shaft 133 also causes the rotating member 145 to generate a centrifugal force in the gas separator 130. The centrifugal force causes the denser fluid (i.e. fluid having more liquid content) to move toward the outer wall of the separator 130 and the less dense fluid (i.e., fluid having more gas content) to collect in the central area of the separator 130. The fluid mixture then travels up the separator 130 and passes through a flow divider 135 positioned at an upper portion of the separator 130.

In one embodiment, the flow divider 135 includes a lower ring 134 and a conical upper end, as illustrated in FIG. 3. Orientation of the flow divider 135 is parallel to and coaxial with the central shaft 133. The lower ring 134 has a diameter that is smaller than the inner diameter of the separator 130. An inner fluid passage 136 connects the interior of the lower ring 134 to exhaust ports 138 in the sidewall of the separator 130. As the fluid flows up and toward the flow divider 135, the more dense fluid located near the outer wall of the separator 130 are outside of the perimeter of the lower ring 134. Thus, the denser fluid is allowed to flow around the flow divider 135 and up the outer passage 142 toward the conical upper end, which leads to the pump 140. The less dense fluid (also referred to herein as "separated gas") located in the inner part of the separator 130 are within the boundary of the lower ring 134. Thus, the separated gas enters the lower ring 134 and is diverted into the fluid passages 136 and out through the exhaust ports 138. In this respect, the flow divider 135 may be used to separate the gas from the liquid. It must be noted that other suitable fluid dividers known to a person of ordinary skill in the art may also be used, for example, a static gas separator.

Referring back to FIG. 2, the ESP assembly 100 is provided with a shroud 150 to guide the flow of the separated gas up the annulus 7. In one embodiment, the shroud 150 is tubular shaped and is positioned around the separator 130 and the pump 140, thereby creating an annular area between the separator 130 and the shroud 150. The length of the shroud 150 is such that the lower end extends below the exhaust ports 138 and the upper end extends above the exhaust ports 138 to a height that is above the liquid level 9 in the wellbore 5. As shown, the lower end of the shroud 150 remains open to the well bore 5. The opening may allow venting of the gas below exhaust ports 138, if the need arises. Alternatively, the lower end of the shroud 150 may be closed to the well bore (see FIG. 2A). The shroud 150 may be coupled to the ESP assembly 100 using a connection member such as a centralizer 137. The centralizer 137 allows fluid flow in the annular area 139 while serving as a connector for the shroud 150 to the ESP assembly 100. In another embodiment, the connection member may be one or more spokes or other suitable connection device capable of allowing fluid flow up the annular area. It must be noted that although the shroud is described as extending above the liquid level in the well, the shroud may be extended to any suitable length. For example, the upper end of the shroud may extend above the exhaust ports to a height that is above a zone where all of the fluids enter the well annulus. This zone may be the perforated zone or entry of multilateral legs in the well.

The ESP assembly 100 may optionally include a motor shroud 160 to guide the flow of wellbore fluid into the ESP assembly 110. In one embodiment, the motor shroud 160 is tubular shaped and is positioned around the motor 120 and the intake port 132. The inner diameter of the motor shroud 160 is larger than the outer diameter of the motor 120 such that fluid flow may occur therebetween. The upper end of the motor shroud 160 is connected to the separator 130 at a location above the intake port 132 and is closed to fluid communication. The lower end of the motor shroud 160 extends at least partially to the motor 120, preferably, below the motor 120. To enter the intake port 132, wellbore fluid must flow down the exterior of the motor shroud 160, around the lower end of the motor shroud 160, and up the interior of the motor shroud 160 toward the intake port 132. The wellbore fluid circulating the motor shroud 160 advantageously cools the motor 120, thereby reducing overheating of the motor 120.

In operation, the ESP assembly 100 may be used to pump water out of a coal bed methane well. The ESP assembly 100 is positioned in the well bore 5 such that the intake port 132 is below the perforations 8 in the wellbore 5. Wellbore fluid 11, which may be mixture of water and gas, may enter the annulus 7 through the perforations 8 and flow downward toward the intake port 132. The fluid 11 may flow past the exterior of the motor shroud 160, then up the interior of the motor shroud 160. The wellbore fluid 11 enters the ESP assembly 100 through the intake port 132 of the separator 130. The motor 120 rotates the rotating members 145 of the separator 130 to apply centrifugal force to the well bore fluid 11. The centrifugal force causes the denser fluid to move toward the sidewall of the separator 130 as the wellbore fluid 11 travels up the separator 130. As the wellbore fluid 11 nears the flow divider 135, the denser, higher water content fluid located near the sidewall is allowed to flow past the inner ring 134 and up the outer passage 142 toward the pump 140, where it is pumped to a tubing for delivery to the surface. The less dense, higher gas content fluid located in the inner area of the separator 130 enters the lower ring 134, flows through the fluid passages 136, and leaves the separator 130 through the exhaust ports 138. After leaving the separator 130, the separated gas is guided up the annular area 139 between the shroud 150 and the separator 130 by the inner wall of the shroud 150. The separated gas is vented out of the shroud 150 at a location that is above the wellbore fluid level 9. In this respect, the separated gas is substantially prevented from commingling with the wellbore fluid 11 flowing toward the lower end of the ESP assembly 100. In this manner, water may be efficiently removed from the coal bed methane well.

Figure 4:
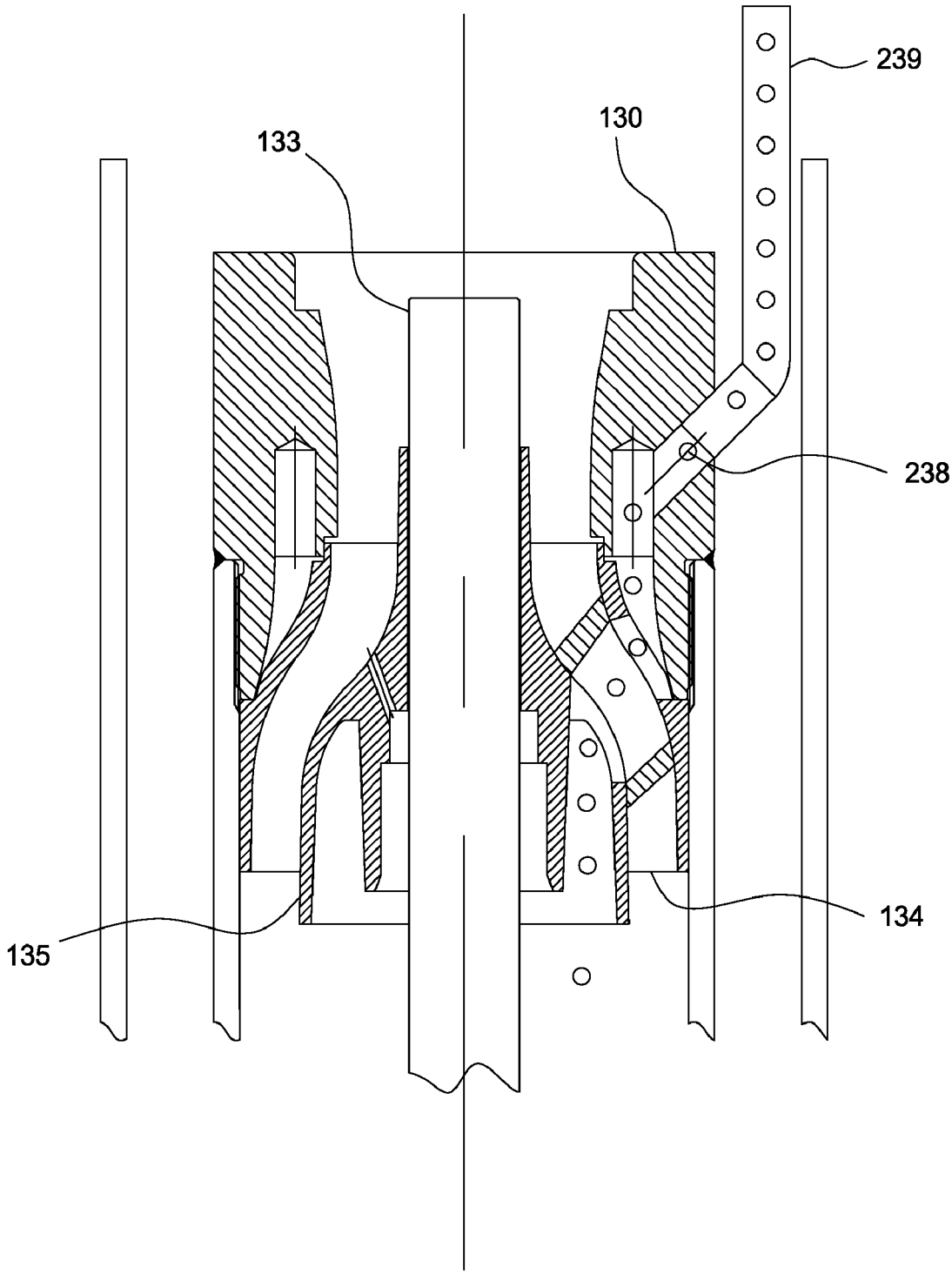
FIG. 4 is a cross-sectional view of the top of a gas separator that has the gas vented in a conduit.

FIG. 4 shows another embodiment of a ESP assembly. In this embodiment, the ESP assembly is equipped with a flow tube 239 connected to the exhaust port 238 of the separator 130. The flow tube is adapted to guide the flow of separated gas from the separator and up the annulus 7. The length of the flow tube 239 is such that the upper end extends to a height above liquid level in the wellbore 5.

Figure 5:
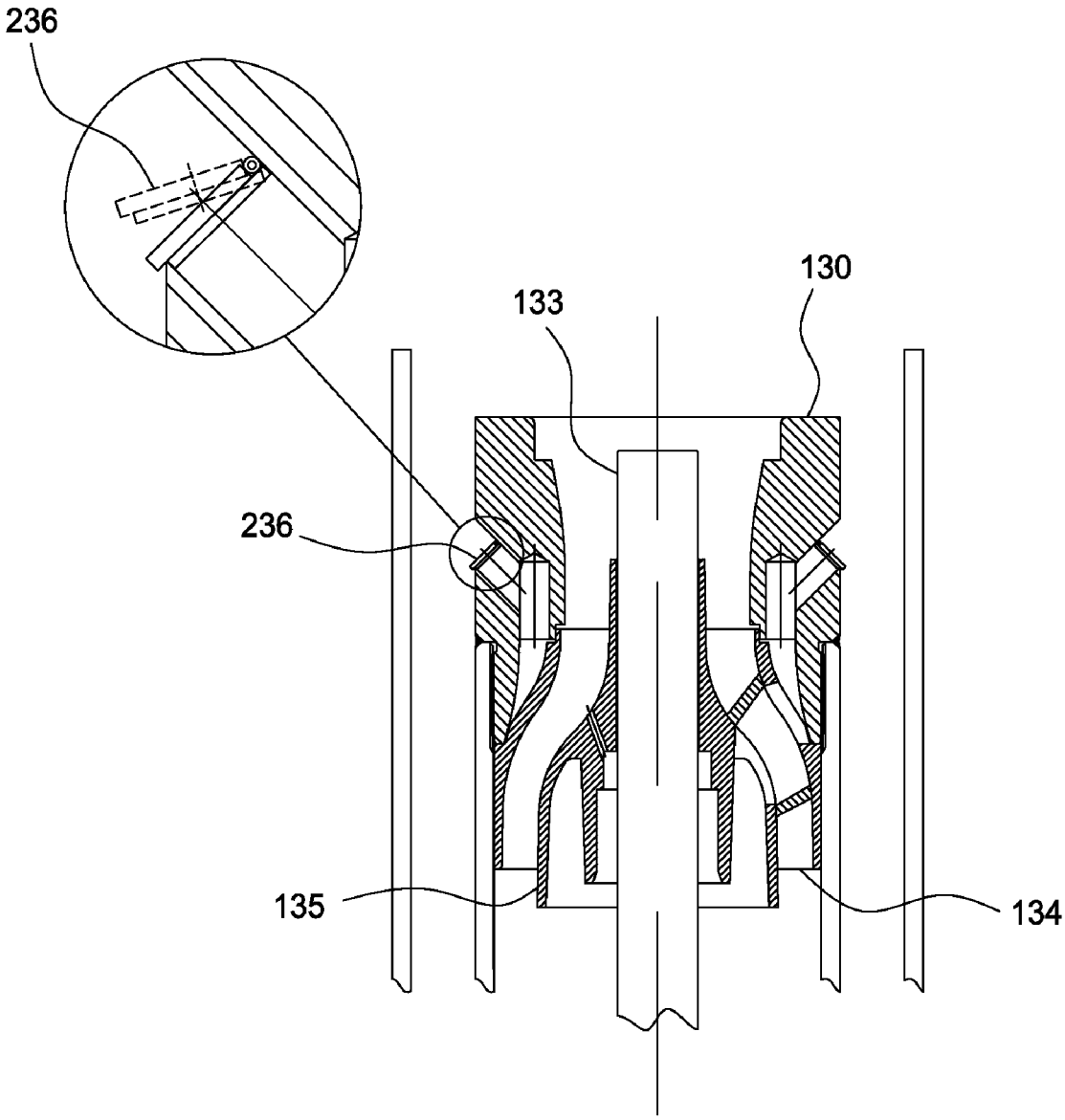
FIG. 5 is a cross-sectional view of the top of a gas separator that has a flapper valve on the gas vents.

FIG. 5 shows another embodiment of a gas separator equipped with a valve to control the flow of separated gas out of the exhaust port 138. In one embodiment, the valve is a flapper valve 236. The flapper valve 236 may be adapted to open at a predetermined force. For example, the flapper valve 236 may be spring biased to close. In this respect, flapper valve will only open if the separated gas in the separator can generated enough force to open the flapper valve 236. In the closed position, the flapper valve 238 keeps fluids from entering through the exhaust port 138. Other suitable types of valves include one-way valves, backflow valve, check valve, and ball valve.

Figure 6A:
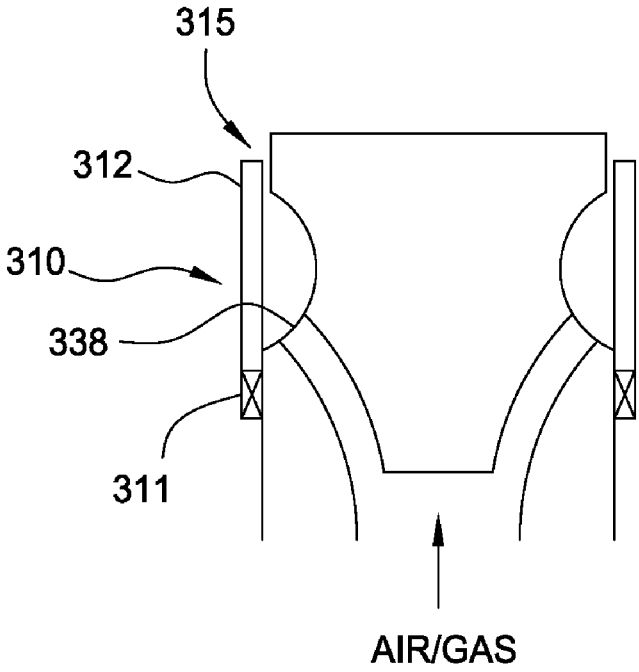
FIG. 6A is a partial view of a gas separator having a tubular sleeve type fluid control device.
Figure 6B:
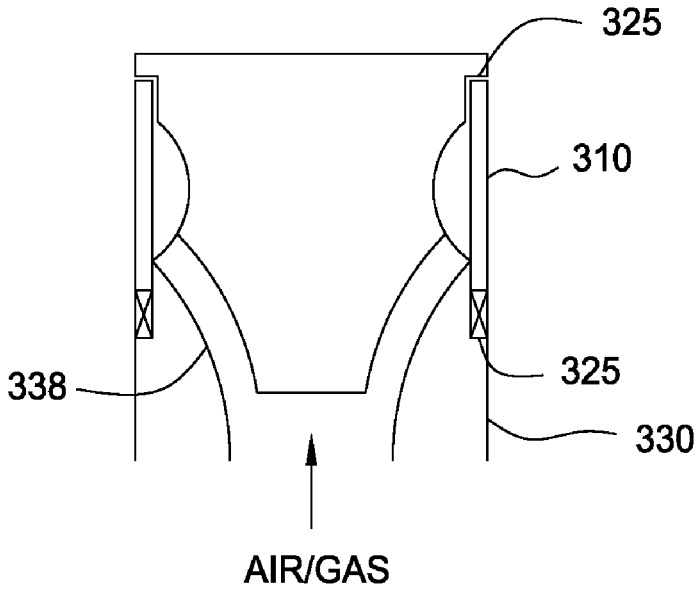
FIG. 6B is a partial view of another embodiment of a gas separator having a tubular sleeve type fluid control device.

FIG. 6A shows another embodiment of a flow control device for the gas separator 330. The flow control device may be a tubular sleeve 310 and positioned around the exhaust port 338 of the gas separator 330. One end 311 of the tubular sleeve 310 is attached to the outer surface of the gas separator 330 while the other end 312 is unattached. The free end 312 has an inner diameter that is slightly larger than the outer diameter of the gas separator 330. The difference in diameters creates an opening 315 for the separated gas to vent. In one embodiment, the tubular sleeve 310 is made of an elastomeric material such as rubber. When a large amount of liquid tries to enter through the opening 315, the liquid would force the elastomeric tubular sleeve 310 against the gas separator 330, thereby closing the opening 315. In another embodiment, the tubular sleeve 310 may be positioned in a recess 325 in the outer surface of the gas separator 330, as illustrated in FIG. 6B. The tubular sleeve 310 placed in the recess 325 would reduce the potential of liquid flowing into the gas separator 330.

Figure 7A:
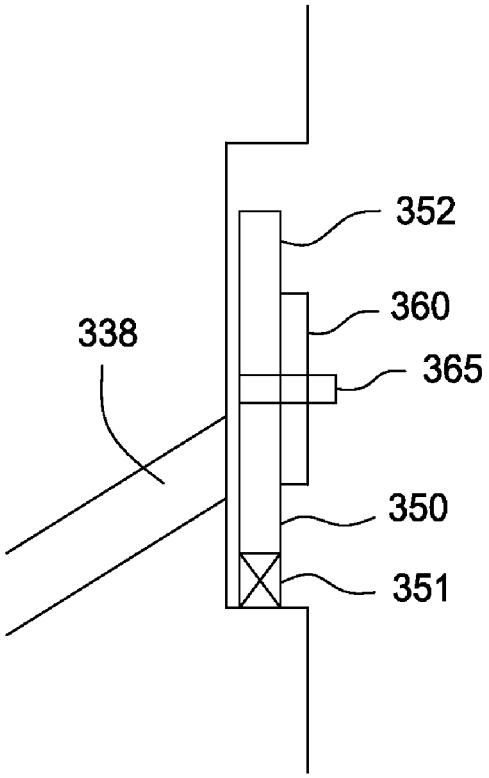
FIGS. 7A-B are partial views of a flap type fluid control device for a gas separator.
Figure 7B:
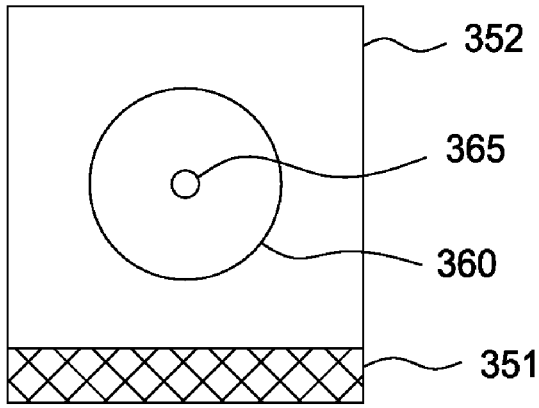

In another embodiment, the flow control device may be one or more flaps 350 disposed adjacent the exhaust port 338, as illustrated in FIGS. 7A-B. The flap 350 may be manufactured from an elastomeric material, but should have sufficient rigidity to remain substantially straight. In one embodiment, a metal support 360 may be attached to the flap 350 to provide additional rigidity to the flap 350. Fasteners such as rivets 365 or adhesive may be used to attach the metal support 360 to the flap 350. One end 351 of the flap 350 is anchored (or attached) to the gas separator while the other end 352 is unanchored. The anchor may be an elastomeric anchor or any suitable anchor capable of keeping the flap 350 substantially vertical. In operation, the flap 350 is hingedly attached to the gas separator. The flap 350 may be pushed open by the venting gas. Thereafter, the flap 350 swings back to the closed position.

While the foregoing is directed to embodiments of the present invention, other and further embodiments of the invention may be devised without departing from the basic scope thereof, and the scope thereof is determined by the claims that follows.

What is claimed is:

1. An electric submersible pump assembly (ESP) for pumping a wellbore fluid from a wellbore, comprising:
- a pump;
- a gas separator:
  - having one or more intake ports, one or more exhaust ports, and a passage, and
  - operable to receive wellbore fluid through the intake ports, discharge a gas stream of the wellbore fluid through the exhaust ports, and feed a liquid stream of the wellbore fluid to the pump through the passage;
- an electric submersible motor for driving the pump;
- a conduit:
  - extending from the gas separator and along the pump,
  - having a lower end in fluid communication with the exhaust ports and closed to the wellbore, and
  - operable to receive the gas stream through the lower end, transport the gas stream while isolating the gas stream from the wellbore fluid, and discharge the gas stream into the wellbore; and
- a first shroud:
  - extending from the gas separator,
  - having an upper end closed to the wellbore and in fluid communication with the intake ports,
  - having a lower end adjacent to a lower end of the motor and open to the wellbore,
  - having an inner diameter greater than an outer diameter of the motor along an entire length of the first shroud, thereby forming a first annulus therebetween, and
  - operable to guide the wellbore fluid along an outer surface of the first shroud, around the lower end, and along the first annulus to the intake ports.

2. The ESP of claim 1, wherein:
- the conduit is a second shroud forming a second annulus between the pump and the second shroud, and
- and the gas stream is transported along the second annulus.

3. The ESP of claim 1, wherein:
- the conduit is a flow tube extending along an outer surface of the pump, and
- the gas stream is transported within a bore of the tube.

4. The ESP of claim 1, wherein the conduit is supported by the gas separator and the pump.

5. The ESP of claim 1, wherein the conduit extends from an upper end of the gas separator.

6. A method of producing a coal bed methane formation, comprising:

operating an electric submersible pump assembly (ESP) disposed in a wellbore at the coal bed methane formation, wherein the ESP:

receives wellbore fluid;

separates the wellbore fluid into a gas stream and a water stream;

transports the separated gas stream through a conduit to a location above a liquid level in the wellbore and discharges the separated gas stream into a first annulus of the wellbore; and pumps the separated water stream to a surface of the wellbore through tubing, wherein:

an intake of the ESP is located below perforations of the wellbore, the ESP comprises a first shroud and an electric motor, a second annulus is formed between the first shroud and the motor, and the first shroud guides the wellbore fluid along an outer surface of the first shroud, around a lower end of the first shroud, and along the second annulus to the intake.

7. The method of claim 6, wherein a submerged portion of the conduit is closed to the wellbore.

8. The method of claim 6, wherein the conduit is a second shroud.

9. The method of claim 6, wherein the conduit is a flow tube.

10. The method of claim 6, wherein the conduit is supported by a gas separator and a pump of the ESP.

11. The method of claim 6, wherein the conduit extends from an upper end of a gas separator of the ESP.

12. An electric submersible pump assembly (ESP) for pumping a wellbore fluid from a wellbore, comprising:

a pump;

a gas separator:

having one or more intake ports, one or more exhaust ports, and a passage, and operable to receive wellbore fluid through the intake ports, discharge a gas stream of the wellbore fluid through the exhaust ports, and feed a liquid stream of the wellbore fluid to the pump through the passage;

an electric submersible motor for driving the pump;

a conduit:

extending from the gas separator and along the pump, having a lower end in fluid communication with the exhaust ports and closed to the wellbore, and operable to receive the gas stream through the lower end, transport the gas stream while isolating the gas stream from the wellbore fluid, and discharge the gas stream into the wellbore; and a first shroud:

extending from the gas separator toward the motor, having an upper end closed to the wellbore and in fluid communication with the intake ports, and having a lower end open to the wellbore, wherein a middle portion of the gas separator is uncovered so that the middle portion is exposed to the wellbore.

13. The ESP of claim 12, wherein:

the conduit is a second shroud forming an annulus between the pump and the second shroud, and and the gas stream is transported along the annulus.

14. The ESP of claim 12, wherein:

the conduit is a flow tube extending along an outer surface of the pump, and the gas stream is transported within a bore of the tube.

15. The ESP of claim 12, wherein the conduit is supported by the gas separator and the pump.

16. The ESP of claim 12, wherein the lower end of the first shroud is adjacent to a lower end of the motor.

17. The ESP of claim 12, wherein the conduit extends from an upper end of the gas separator.

* * * * *